US006700362B2

(12) United States Patent
Engl

(10) Patent No.: US 6,700,362 B2
(45) Date of Patent: Mar. 2, 2004

(54) SWITCHABLE CURRENT SOURCE

(75) Inventor: Bernhard Engl, Miesbach (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/196,657

(22) Filed: Jul. 16, 2002

(65) Prior Publication Data

US 2003/0020439 A1 Jan. 30, 2003

(30) Foreign Application Priority Data

Jul. 16, 2001 (DE) ..... 101 34 450

(51) Int. Cl.[7] ..... G05F 1/40; G05F 1/565

(52) U.S. Cl. ..... 323/282; 323/275

(58) Field of Search ..... 323/282, 374, 323/275, 313, 314, 317, 312, 316; 330/285, 208, 300, 277

(56) References Cited

U.S. PATENT DOCUMENTS

| | | | | |
|---|---|---|---|---|
| 3,303,411 A | | 2/1967 | Gately | |
| 4,814,688 A | * | 3/1989 | Colles | 323/317 |
| 5,142,219 A | * | 8/1992 | Hsu et al. | 323/314 |

* cited by examiner

*Primary Examiner*—Rajnikant B. Patel
(74) *Attorney, Agent, or Firm*—Laurence A. Greenberg; Werner H. Stemer; Gregory L. Mayback

(57) ABSTRACT

The current source can be switched between a current-controlled mode and a voltage-controlled mode. A special type of drive to the current source has the result that it operates correctly and in a stable manner under all circumstances with only two input connections.

14 Claims, 2 Drawing Sheets

SWITCHABLE CURRENT SOURCE

BACKGROUND OF THE INVENTION

Field of the Invention

The present invention relates to a current source that can be switched between a current-controlled mode and a voltage-controlled mode.

Such current sources are used in a multitude of applications, for example in connection with digital/analog converters.

In the current-controlled mode, the switchable current source is supplied with a current Iref which passes on to other circuit sections on an integrated circuit via a current mirror. In the voltage-controlled mode, the switchable current source is supplied with a reference voltage Vref which converts it to a reference current Iref=Vref/R via a resistor R, and this current, too, is passed on to the other circuit sections of the integrated circuit via the current mirror.

These two modes are required particularly frequently in video chips for the consumer market in order to provide manufacturers of television sets with a greater flexibility in the basic setting of the picture information outputs for the RGB signals.

A circuit configuration suitable for this purpose is described in U.S. Pat. No. 4,814,688. That circuit configuration has the disadvantage, however, that there an operational amplifier no longer has negative feedback in the current-controlled mode which can trigger fluctuations in its output and, as a result, substrate disturbances which can lead to picture faults.

That disadvantage is eliminated by the circuit configuration described in U.S. Pat. No. 5,142,219. This is done by the operational amplifier being switched off in the current-controlled mode with the aid of a comparator and a circuit called a "power-down" circuit.

A significant disadvantage of the circuit configuration known from U.S. Pat. No. 5,142,219 consists, as can be seen from FIGS. 5 and 6 of that document, in the necessity of having to provide four package pinouts of an integrated circuit for the range of functions required. As a result, the switchable current source becomes larger and more expensive.

SUMMARY OF THE INVENTION

It is accordingly an object of the invention to provide a switchable current source, which overcomes the above-mentioned disadvantages of the heretofore-known devices and methods of this general type and which provides for a current source which can be switched between a current-controlled mode and a voltage-controlled mode, which operates in a stable manner under all circumstances and which manages with a minimum number of package pinouts.

With the foregoing and other objects in view there is provided, in accordance with the invention, a current source that can be switched between a current-controlled mode and a voltage-controlled mode. The circuit comprises:

first and second input connections and one output connection;

a transistor having a drain terminal connected to the first input connection and having a gate or base connected to the output connection;

an operational amplifier having a first input terminal connected to the first input connection and a second input terminal connected to the second input connection;

controllable switches connected to ensure that the transistor is driven by the output signal of the operational amplifier in the voltage-controlled mode and is driven by the voltage at the drain terminal of the transistor in the current-controlled mode;

a comparator generating an output signal for controlling the controllable switches;

the comparator having an input terminal connected to the second input connection; and wherein a potential to be applied to the second input connection in the current-controlled mode clearly differs from a occurring at the second input connection in the voltage-controlled mode and from a potential occurring at the first input connection in the current-controlled mode.

In accordance with an added feature of the invention, when the current source is to be operated in the current-controlled mode:

the first input connection is supplied with a reference current; and the second input connection is placed at a potential by way of which the output signal of the comparator is brought to a value by way of which the switches are switched to a position the switches must assume in the current-controlled mode.

In accordance with an additional feature of the invention, when the current source is to be operated in the voltage-controlled mode:

the first input connection is connected to a reference potential via a resistor; and a reference voltage is applied to the second input connection.

In accordance with another feature of the invention, the potential applied to the second input connection in the current-controlled mode is selected such that a threshold voltage of the comparator lies between the potential applied to the second input connection and a potential at the second input connection in the voltage-controlled mode.

In accordance with a further feature of the invention, the threshold voltage of the comparator is selected to lie in a vicinity of a potential to be applied to the second input connection in the current-controlled mode.

In accordance with again an added feature of the invention, the threshold voltage of the comparator is selected to lie in a vicinity of a potential of one pole of a supply voltage.

In accordance with again an additional feature of the invention, the threshold voltage of the comparator is selected to lie closer to a potential of one pole of the supply voltage than to a potential of the other pole of the supply voltage.

In accordance with again another feature of the invention, the threshold voltage of the comparator is selected to lie 100 to 1500 mV above the potential of the pole of the supply voltage exhibiting the lower potential.

In accordance with again a further feature of the invention, the threshold voltage of the comparator is selected to lie 100 to 1500 mV below the potential of the pole of the supply voltage exhibiting the higher potential.

In accordance with a concomitant feature of the invention, the potential to be applied to the second input connection in the current-controlled mode, and the potential occurring at the first input connection in the current-controlled mode, are selected such that a difference therebetween is so great that the operational amplifier is overdriven.

The current source according to the invention is distinguished by the fact that it is provided with only two input connections and one output connection, the output connection being connected to the gate or base terminal of a transistor, the current source having controllable switches which ensure that the transistor is driven by the output signal of an operational amplifier in the voltage-controlled mode and is driven by the voltage occurring at the drain terminal of the transistor in the current-controlled mode, the switches being controlled in dependence on the output signal of a comparator, the first input connection of the current source being connected to the drain terminal of the transistor and a first input terminal of the operational amplifier, the second input connection of the current source being connected to the second input terminal of the operational amplifier and one of the input terminals of the comparator, and the potential to be applied to the second input connection of the current source in the current-controlled mode clearly differing both from the potential occurring at the second input connection of the current source in the voltage-controlled mode and from the potential occurring at the first input connection of the current source in the current-controlled mode.

The fact that the current source manages with only two input connections and one output connection is caused, in particular, by the particular choice of voltages applied to the input connections or, respectively, the impressed currents.

Due to the fact that the potential applied to the second input connection of the current source in the current-controlled mode is selected in such a manner that it clearly differs from the potential applied to this input connection in the voltage-controlled mode, the switching threshold of the comparator can be set to a value which ensures under all circumstances that the switches controlled by the comparator are operated in such a manner that the current source operates in the current-controlled mode when it is intended to operate in the current-controlled mode and that the current source operates in the voltage-controlled mode when it is intended to operate in the voltage-controlled mode.

Due to the fact that the potential applied to the second input connection of the current source in the current-controlled mode is selected in such a manner that it clearly differs from the potential present at the first input connection of the current source in the current-controlled mode, a large voltage difference or, more precisely, a voltage difference overdriving the operational amplifier, is obtained at the input terminals of the operational amplifier as a result of which the operational amplifier always outputs the maximum output signal and the output signal, therefore, is not subject to any, or, at the most, negligibly small fluctuations.

This results in a reliable switchover resistant to disturbances, on the one hand, and, on the other hand, in an output current which is stable under all circumstances, even though the current source only has two input connections.

Other features which are considered as characteristic for the invention are set forth in the appended claims.

Although the invention is illustrated and described herein as embodied in a switchable current source, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

The following description pertains to a switchable current source forming a part of an integrated circuit. It will be readily understood, however, that the current source can also be implemented in any other way.

Figure 1:
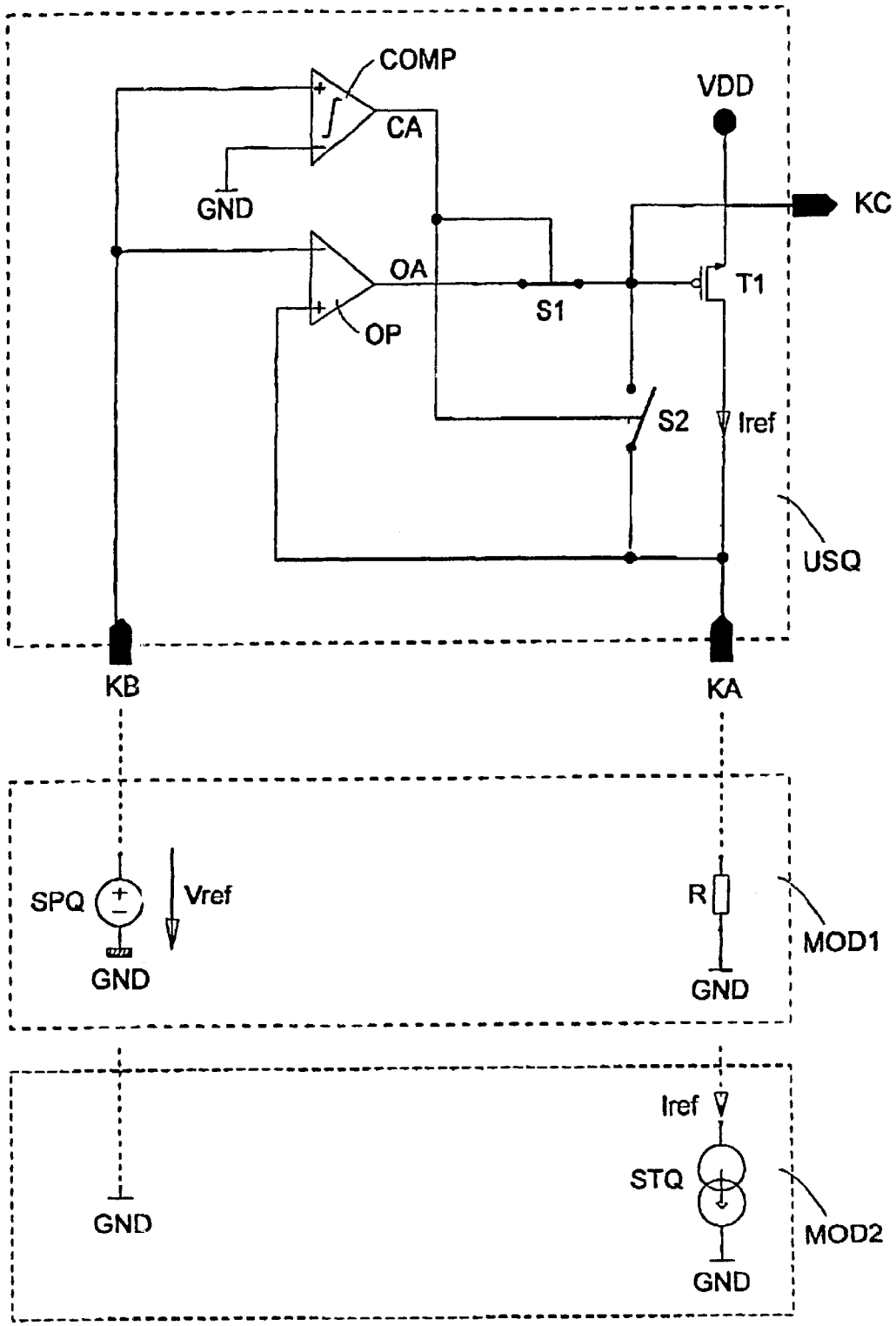
FIG. 1 is a circuit diagram of the basic structure of the current source according to the invention.

Referring now to the figures of the drawing in detail and first, particularly, to FIG. 1 thereof, there is shown a switchable current source designated by the reference USQ. It contains an operational amplifier OP, a comparator COMP, controlled switches S1 and S2, and at least one transistor T1. Three connecting terminals KA, KB and KC are provided. The terminals KA and KB represent a first and a second input connection and terminal KC represents an output connection.

Of the input and output connections KA to KC, the output connection KC is connected to the gate or base terminal of the transistor T1;

the first input connection KA is connected to the drain terminal of the transistor T1 and to a first input terminal + of the operational amplifier OP; and the second input connection KB of the current source is connected to the second input terminal – of the operational amplifier OP and to one of the input terminals of the comparator COMP.

The transistor T1 is arranged in such a manner that, acting together with a further transistor connected to the output connection KC, it forms a current mirror which has the effect that the current flowing through transistor T1 is mirrored in the further transistor connected to the output connection KC.

In the example considered, the transistor T1 is a p-channel MOSFET, the source terminal of which is connected to the positive pole VDD of the supply voltage. However, it can also be replaced by a bipolar PNP transistor depending on the process technology used for implementing the integrated circuit.

Exchanging the supply voltage terminals VDD, GND provides a complementary circuit wherein the transistor T1 can be implemented by an N-channel MOSFET or a bipolar NPN transistor.

The controllable switches S1 and S2 ensure that the transistor T1 is driven by the output signal OA of the operational amplifier OP in the voltage-controlled mode and is driven by the voltage occurring at the drain terminal of transistor T1 in the current-controlled mode. The switches S1 and S2 themselves are controlled in dependence on the output signal CA of the comparator COMP.

The block MOD1 shows the external circuitry connected to terminals KA and KB of the switchable current source USQ for the voltage-controlled mode:

Accordingly, in the voltage-controlled mode, a resistor R is connected to the terminal KA; and a reference voltage Vref coming from a voltage source SPQ is applied to terminal KB.

The reference voltage Vref is selected in such a manner that the output CA of the comparator COMP assumes a state wherein the controlled switch S1 is closed and the controlled switch S2 is open; in the example considered, the reference voltage Vref must be above the switching threshold of the comparator COMP for this purpose. Due to the closed, switch S1 and the open switch S2, the operational amplifier OP has such a negative feedback that a voltage, which, in the ideal case, corresponds to the voltage at terminal KB with respect to the reference potential GND occurs across the resistor R. In this process the control loop consisting of the operational amplifier OP and transistor T1 brings the terminal KC to a potential at which the transistor T1 generates a reference current Iref=Vref/R. By connecting the gates or the base of other transistors to the terminal KC, a current mirror can be formed by means of which the reference current can be distributed over further sections within the integrated circuit.

The block MOD2 shows the external circuitry connected to terminals KA and KB of the switchable current source USQ for the current-controlled mode:

Accordingly, in the current-controlled mode, the terminal KA is supplied with a reference current Iref coming from a current source STQ, and the terminal KB is placed at a potential at which the comparator COMP assumes at its output CA a state at which the controlled switch S1 is open and the controlled switch S2 is closed.

Due to the fact that the switch S1 is opened in the current-controlled mode, the operational amplifier OP does not have any influence on the conditions occurring at terminal KC; these are exclusively determined by the reference current Iref supplied to the terminal KA.

The potential applied to terminal KB in the current-controlled mode is preferably selected in such a manner that it clearly differs both from the potential applied to the terminal KB in the voltage-controlled mode (the reference potential Vref)

and from the potential present at the terminal KA in the current-controlled mode.

Due to the fact that the potential applied to the terminal KB in the current-controlled mode is selected in such a manner that it clearly differs from the potential applied to terminal KB in the voltage-controlled mode (the reference potential Vref), the switching threshold of the comparator COMP determining the position of the switches S1 and S2 can be set to a value by means of which it can be ensured under all circumstances that the switch S1 is closed and the switch S2 is opened in the voltage-controlled mode and that the switch S1 is opened and the switch S2 is closed in the current-controlled mode.

This eliminates the possibility that the current source operates in the current-controlled mode when it is intended to operate in the voltage-controlled mode and/or that the current source operates in the voltage-controlled mode when it is intended to operate in the current-controlled mode.

Due to the fact that the potential applied to the terminal KB in the current-controlled mode is selected in such a manner that it clearly differs from the potential present at terminal KA in the current-controlled mode, a large voltage difference, more precisely a voltage difference overdriving the operational amplifier, occurs at the input terminals of the operational amplifier OP, as a result of which the operational amplifier OP always outputs the maximum output signal and the output signal, therefore, is not subject to any or at the most negligibly small fluctuations.

In the example considered, the various requirements for the ratios of the amplitudes of the voltages applied to terminals KA and KB are met due to the fact that in the current-controlled mode, the terminal KB is connected to the negative pole GND of the supply voltage.

This results in a reliable switchover resistant to disturbances, on the one hand, and, on the other hand, in an output current which is stable under all circumstances.

A comparator COMP is preferably used, the internal switching threshold of which is in the vicinity of the potential applied to terminal KB in the current-controlled mode, that is to say, for example, some 100 mV above GND in the example considered. The potential (GND) applied to terminal KB in the current-controlled mode places such a comparator in the state which it must be in for placing the current source into the current-controlled mode (by appropriate drive to the switches S1 and S2) and, on the other hand, the potential (Vref) applied to terminal KB in the voltage-controlled mode places it into the state which it must be in for placing the current source into the voltage-controlled mode (by appropriate drive to the switches S1 and S2). The latter is the case largely independently of the selected reference voltage Vref; the only condition is that it must not be between GND and the switching threshold of the comparator COMP which, however, can be avoided without problems in practice since, of course, the current generated by the current source depends not only on the reference voltage Vref but, to the same extent, on the resistor R connected to terminal KA.

For the sake of completeness, it should be noted that in the complementary case, in the current-controlled mode, terminal KB would be connected to the positive supply potential VDD and a comparator COMP would be used, the switch threshold of which is some 100 mV below VDD.

The small switching thresholds used can be achieved by an asymmetry in comparator circuits which is intentionally designed in, but the use of transistor switching thresholds is also conceivable which lowers the circuit expenditure for the comparator (this will be explained in greater detail later with reference to FIG. 2).

When the terminal KB is connected to GND, the potential applied to the terminal KB is in every case far below the potential at terminal KA which is identical to the potential at terminal KC due to the controllable switch S2 being closed in the current-controlled mode. This is the result of the higher supply voltage VDD minus the gate-source voltage or the base-emitter voltage of the transistor T1 and is in every case clearly above the supply potential GND. As a result, the input marked plus of the operational amplifier OP is at a very much higher potential than its input marked minus and the output of a suitable operational amplifier is then reliably at a stable maximum value and does not shift. This eliminates the risk of a fluctuation at this output without having to use the "power-down" circuit proposed in the above-mentioned U.S. Pat. No. 5,142,219. The current source described above with reference to FIG. 1 has fewer elements than the current source described in U.S. Pat. No. 5,142,219 and, moreover, needs two package pinouts as input connections, at the most.

It is also conceivable to allow the switchover to occur within an integrated circuit e.g. by connecting other controllable switches to terminals KA and KB of the current source circuit USQ, and by integrating the reference voltage source SPQ and/or the reference current source STQ and/or the resistor R on the same semiconductor body, wherein arrangement the other controllable switches are then driven, for example, by a digital configuration register of the integrated circuit. The current source circuit described here thus represents a flexible functional block which can be used in many ways.

Figure 2:
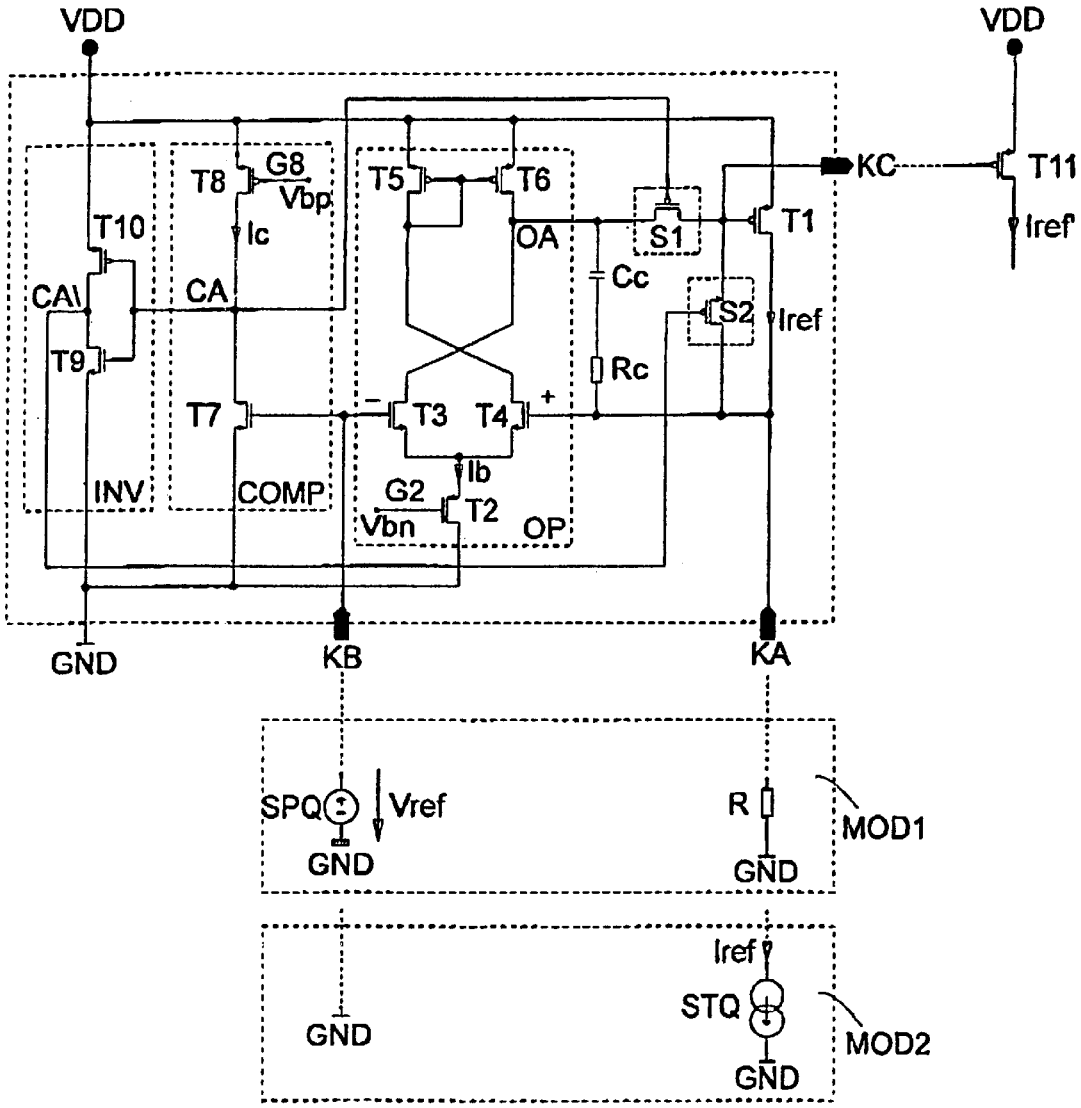
FIG. 2 is a circuit schematic showing an exemplary practical implementation of the current source of FIG. 1.

FIG. 2 shows an exemplary practical implementation of the circuit according to FIG. 1 in a CMOS process. For this example, too, it holds true that a complementary circuit can be derived by exchanging the supply voltage terminals VDD, GND and replacing n-channel MOSFETs with p-channel MOSFETs.

The operational amplifier OP is implemented by transistors T2 to T6 and the comparator COMP is implemented by transistors T7 and T8 which are interconnected as shown in FIG. 2.

The output terminal CA of the comparator COMP is connected to an inverter INV formed by transistors T9 and T10; this inverter INV forms a complementary signal CA\ from the signal output from the comparator.

The controllable switches S1 and S2 are implemented by p-channel MOSFETs, the gate terminals of which are connected to the signals CA (switch S1) and CA\ (switch S2), respectively.

Between the positive input terminal + of the operational amplifier OP and the output terminal OA of the operational amplifier OP, a resistor Rc and a capacitor Cc connected in series therewith are arranged. These elements are used for compensating for the frequency response of the control loop which is produced when the switch S1 is closed and the switch S2 is open, that is to say in the voltage-controlled mode of the current source.

The operation of the circuit corresponds to the basic principle explained with reference to FIG. 1. In the text which follows, only the peculiarities to be found in the mode switching and the comparators will be discussed.

The comparator COMP is a single circuit since high accuracy of the switching threshold is not of importance. The switching threshold is essentially given by the threshold voltage of transistor T7 and its process gain, and by a current Ic which is supplied to it via transistor T8. The gate terminal G8 of the latter is connected to a suitable potential Vbp for this purpose so that the transistor T8 supplies a defined drain current Ic.

In the current-controlled mode, external circuitry according to block MOD2 is connected to terminals KA, KB. In other words at terminal KB, a potential is present which is below the threshold voltage of the transistor T7, GND in the example. As a result, transistor T7 is cut off and the current Ic from transistor T8 brings the output CA of the comparator COMP to the potential VDD as a result of which switch S1 is opened. The output CA\ of the inverter INV goes to GND, as a result of which switch S2 is closed. The circuit is thus placed into the current-controlled mode. If then a current source STQ is connected to terminal KA and draws from it a current Iref, a potential which produces a mirrored current Iref' in a transistor T11 connected thereto with its gate occurs at terminal KC. It is possible to have a multiplicity of such transistors within such a current mirror in order to multiply the current Iref' and to supply it to other circuits.

When the transistor T7 is cut off, the transistor T3 of the differential stage T3/T4 of the operational amplifier is also cut off. In consequence, the bias current Ib supplied to the differential stage via the low-end current source T2, which is dependent on a potential Vbn at the gate terminal G2 of the transistor T2, completely flows to the current mirror T5, T6 via transistor T4. Since transistor T3 is cut off, a potential VDD occurs at the output OA of the operational amplifier. This eliminates fluctuations of this output due to the negative feedback being switched off.

In the voltage-controlled mode, external circuitry according to block MOD1 is connected to terminals KA, KB. At the terminal KB, a potential Vref is present which is sufficiently far above the threshold voltage of T7, typically 1.23 V from a band gap reference or higher, so that T7 could draw a drain current which is greater than the current Ic coming from T8. Since the current Ic is lower than the possible drain current of T7 due to the design of the circuit and the choice of the gate potential Vbp, it pulls the output CA of the comparator down to GND potential as a result of which switch S1 is closed. The output CA\ of the inverter INV goes to VDD as a result of which the switch S2 is opened. The circuit is thus placed into the voltage-controlled mode. If then a resistor R is connected to GND at terminal KA, the operational amplifier, which now has negative feedback, transfers the potential Vref to the resistor R by controlling the gate terminal of T1 via the switch S1, for which the current Iref=Vref/R must flow in T1. A transistor T11 connected to terminal KC thus also supplies a reference current Iref=Vref/R. The accuracy of Iref essentially depends on the offset voltage of the operational amplifier which is why the reference voltage Vref should preferably be selected in such a manner that its amount is much higher than the offset voltage. In the implementation chosen here, Vref can never be selected to be too small, due to the threshold voltage designed into the comparator, so that a typical practical offset voltage of a few 10 mV is not so very important. There would be no purpose in greater expenditure, for example using a more elaborate operational amplifier, since the mismatch error produced by statistical spread in the transistors of an output current mirror connected to KC is the dominant cause of deviations of Iref from the ideal value in both operating modes.

In the voltage-controlled mode, T1, together with the resistor R connected to the terminal KA, forms an amplifier stage which can produce a relatively wide range of values of the gain factor F=Gm*R depending on the mutual conductance Gm of the transistor T1 and the value of R. The series circuit of the resistor Rc and the capacitor Cc produces a Miller compensation of the entire control loop and, if it is expertly dimensioned, is capable of guaranteeing its stability for any value of the gain factor F occurring in practice. This dimensioning can be assumed as known from the theory of the so-called Miller-compensated operational amplifier. The dynamic characteristic of the circuit is essentially dependent on the mutual conductance of the transistors T3, T4 in the operational amplifier and on the value of the capacitor Cc and the low-end current Ib, and not on the gain factor F.

It is also possible to obtain a multiple of the reference current or a fraction thereof by scaling the current mirror formed by the transistors T1 and T11, for example by changing the range of the transistors.

A multiplicity of bias circuits such as, e.g. the bias circuit from Wai-Kai Chen: "The Circuit and Filters Handbook", CRC Press 1995, FIG. 57.56, page 1686 are suitable for generating the gate potentials Vbn and Vbp.

The gate potentials Vbn and Vbp can be picked up directly at the gates of the corresponding p-channel and n-channel current mirror of this bias circuit.

To meet higher requirements for accuracy and better suppression of supply disturbances, the current sources in the exemplary circuit of FIG. 2 can be additionally provided with cascode transistors. It is easily possible to make functional blocks such as COMP and OP more elaborate without deviating from the basic concept of the invention according to FIG. 1.

The current source described operates in a stable manner under all circumstances independently of the details of the practical implementation and, in doing so, manages with only two input connections.

I claim:

1. A current source that can be switched between a current-controlled mode and a voltage-controlled mode, comprising:

first and second input connections and one output connection;

a transistor having a load path terminal connected to said first input connection and a control terminal connected to said output connection;

an operational amplifier having a first input terminal connected to said first input connection and a second input terminal connected to said second input connection;

controllable switches connected such that said transistor is driven by the output signal of said operational amplifier in the voltage-controlled mode and is driven by a voltage at said load path terminal of said transistor in the current-controlled mode;

a comparator generating an output signal for controlling said controllable switches;

said comparator having an input terminal connected to said second input connection; and wherein a potential to be applied to said second input connection in the current-controlled mode clearly differs from a potential at said second input connection in the voltage-controlled mode and from a potential at said first input connection in the current-controlled mode.

2. The current source according to claim 1, wherein, when the current source is to be operated in the current-controlled mode:

said first input connection is supplied with a reference current; and said second input connection is placed at a potential by way of which the output signal of said comparator is brought to a value by way of which said switches are switched to a position said switches must assume in the current-controlled mode.

3. The current source according to claim 1, wherein, when the current source is to be operated in the voltage-controlled mode:

said first input connection is connected to a reference potential via a resistor; and a reference voltage is applied to said second input connection.

4. The current source according to claim 1, wherein the potential applied to said second input connection in the current-controlled mode is selected such that a threshold voltage of said comparator lies between the potential applied to said second input connection and a potential at said second input connection in the voltage-controlled mode.

5. The current source according to claim 1, wherein the threshold voltage of said comparator is selected to lie in a vicinity of a potential to be applied to said second input connection in the current-controlled mode.

6. The current source according to claim 1, wherein the threshold voltage of said comparator is selected to lie in a vicinity of a potential of one pole of a supply voltage.

7. The current source according to claim 6, wherein the threshold voltage of said comparator is selected to lie closer to a potential of one pole of the supply voltage than to a potential of the other pole of the supply voltage.

8. The current source according to claim 7, wherein the threshold voltage of said comparator is selected to lie 100 to 1500 my above the potential of the pole of the supply voltage exhibiting the lower potential.

9. The current source according to claim 7, wherein the threshold voltage of said comparator is selected to lie 100 to 1500 my below the potential of the pole of the supply voltage exhibiting the higher potential.

10. The current source according to claim 1, wherein the potential to be applied to said second input connection in the current-controlled mode, and the potential occurring at said first input connection in the current-controlled mode, are selected such that a difference therebetween is so great that said operational amplifier is overdriven.

11. The current source according to claim 1, wherein said transistor is a MOSFET, said control terminal is a gate, and said load path terminal is a drain.

12. The current source according to claim 1, wherein said transistor is a bipolar transistor, said control terminal is a base, and said load path terminal is a collector.

13. A current source switchable between a current-controlled mode and a voltage-controlled mode, comprising: first and second input connections and one output connection;

a transistor having a drain terminal connected to said first input connection and having a gate or base connected to said output connection;

an operational amplifier having a first input terminal connected to said first input connection and a second input terminal connected to said second input connection;

controllable switches connected to ensure that said transistor is driven by the output signal of said operational amplifier in the voltage-controlled mode and is driven by the voltage at said drain terminal of said transistor in the current-controlled mode;

a comparator generating an output signal for controlling said controllable switches;

said comparator having an input terminal connected to said second input connection; and wherein a potential to be applied to said second input connection in the current-controlled mode clearly differs from a occurring at said second input connection in the voltage-controlled mode and from a potential occurring at said first input connection in the current-controlled mode.

14. The current source according to claim 1, wherein said controllable switches include a first controllable switch for switchingly connecting the output signal of said operational amplifier to said control terminal of said transistor.

* * * * *

UNITED STATES PATENT AND TRADEMARK OFFICE

CERTIFICATE OF CORRECTION

PATENT NO. : 6,700,362 B2
DATED : March 2, 2004
INVENTOR(S) : Bernhard Engl

It is certified that error appears in the above-identified patent and that said Letters Patent is hereby corrected as shown below:

Column 10,
Line 7, should read as follows:
-- 1500mV below the potential of the pole of the supply --
Line 11, should read as follows:
-- 1500mV below the potential of the pole of the supply --

Signed and Sealed this

Eighth Day of June, 2004

JON W. DUDAS
*Acting Director of the United States Patent and Trademark Office*